US005478281A

United States Patent [19]

Forton

[11] Patent Number: 5,478,281

[45] Date of Patent: Dec. 26, 1995

[54] HIGH VOLUME FLOW WATER SLIDE FOR SWIMMING POOLS

[76] Inventor: Rex R. Forton, 245 Preston, Waterford, Mich. 48328

[21] Appl. No.: 233,667

[22] Filed: Apr. 26, 1994

[51] Int. Cl.[6] ..... A63G 21/18

[52] U.S. Cl. ..... 472/117; 472/116; 472/128

[58] Field of Search ..... 472/116, 117, 472/128

[56] References Cited

U.S. PATENT DOCUMENTS 2,446,905 8/1948 Buffum ..... 472/117

4,805,898 2/1989 Jacober et al. ..... 472/117

5,213,547 5/1993 Lochtefeld ..... 472/117

OTHER PUBLICATIONS

Drawing from Robert Luczun of Clifton, Nev. 07013 (1 page).

*Primary Examiner*—Carl D. Friedman

*Assistant Examiner*—W. Glenn Edwards

*Attorney, Agent, or Firm*—Dykema Gossett

[57] ABSTRACT

A slide for use with swimming pools has at least one flow fitting in a side rail of the slide and directs fluid flow from the side rail onto the slide bed, thereby providing a film of water over substantially all of the bed.

2 Claims, 1 Drawing Sheet

HIGH VOLUME FLOW WATER SLIDE FOR SWIMMING POOLS

TECHNICAL FIELD

The present invention relates generally to swimming pool slides, and more specifically to means of wetting swimming pool slides.

BACKGROUND OFT HE INVENTION

Presently known means of wetting swimming pool slides employ relatively low volumetric flow rates, the flow rate typically being characterized as a trickle. Such a flow rate is typically adequate to wet the entire bed of the slide only after a person has gone down the slide and disbursed the water thereacross. Subsequent users can move down the slide in relative comfort. However, the first person down the slide may experience some discomfort from contact with nonwetted portions of the slide. Known means of wetting slides are ineffective at providing a film of water over the entire bed of the slide.

One type of known slide wetting means employs a tube extending across a top of the slide with a plurality of holes therein. The holes are too small to provide the desired wetting effect given the typically available water pressure. Water resultantly trickles from the holes and down the slide. Additionally, flow to the tube is commonly limited by the diameter of the hose supplying the tube being no larger than the tube.

It is desired to provide a slide having wetting means which maintains a film of water over substantially the entire bed of the slide. It is also desired to provide a slide with a wetting means which induce minimal back pressure at a high volumetric rate of flow, thereby accommodating a high rate of flow therethrough at relatively low outlet pressures typically associated with swimming pool filter pumps having multiple flow outlets in parallel with one another. It is also desired to be able to easily convert a slide with no wetting means or inadequate wetting means to one having wetting means able to maintain a film of water over the slide bed.

SUMMARY OF THE INVENTION

A slide is disclosed for use with swimming pools comprising an inclined bed with a top and a bottom and having upwardly extending siderails along the bed. The slide includes at least one flow fitting mounted in one of the side rails proximate to the top of the slide with an opening positioned to direct flow onto the slide bed from the side rail.

The present invention provides a slide having a plentiful supply of water flowing theredown dispersed thereacross, thereby minimizing direct skin contact with the slide bed by a person sliding theredown. The slide maintains a film of water over substantially the entire bed of the slide. The disclosed slide wetting means induces only minimal back pressure at high rates of flow. The present disclosure also describes how a conventional slide can be modified to one providing a film of water over substantially all of the slide bed.

DESCRIPTION OF THE PREFERRED EMBODIMENT

Figure 1:
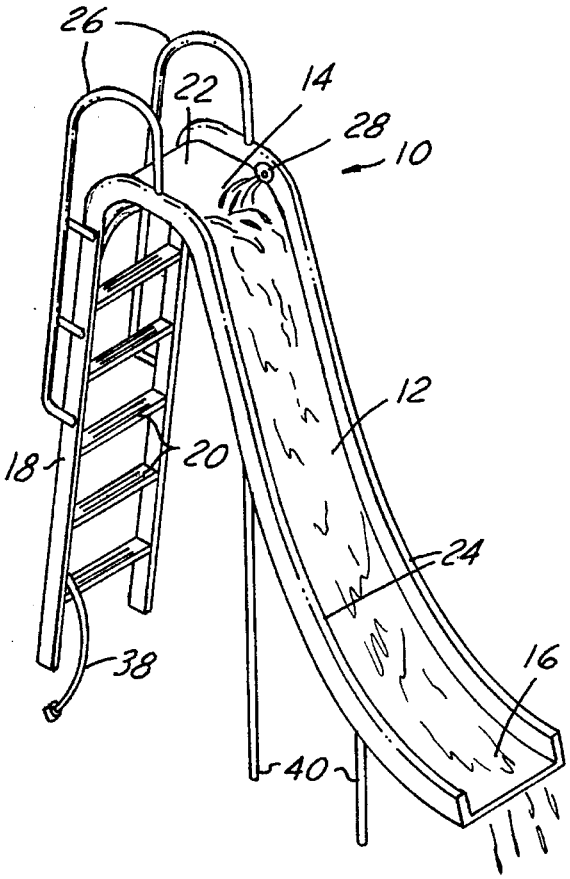
FIG. 1 is a perspective view of a pool slide.
Figure 2:
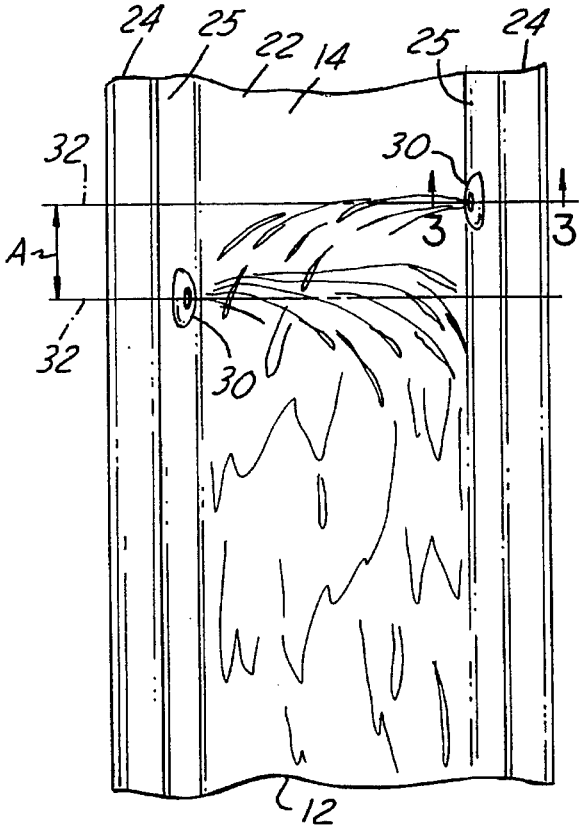
FIG. 2 is a broken out section of a plan view of the slide of FIG. 1.
Figure 3:
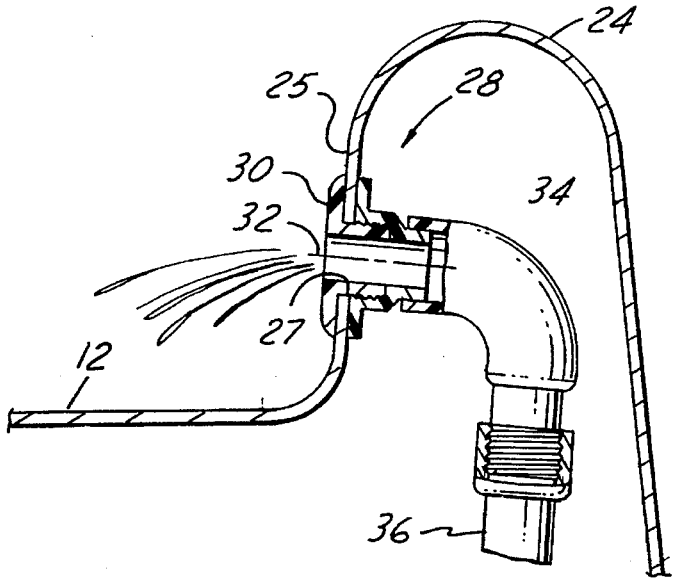
FIG. 3 is a sectional end view of the slide in the direction of arrows 3 of FIG. 2.

A swimming pool slide 10 is disposed at an edge of a swimming pool (not shown) for people to slide down and into the pool. An inclined bed 12 extends from a top 14 to a bottom 16 which typically extends out over the pool. A ladder portion 18 with a plurality of steps 20 supports the top 14 of the inclined bed 12 in an elevated position. An approximately horizontal start section 22 is disposed between the top 14 of the inclined bed 12 and the ladder portion 18. The start section 22 is continuous with the inclined bed 12.

A siderail 24 extends upward from each side of the bed 12 and the start section 22. The siderails have a height of approximately 2 ½ inches above the bed 12 and inward facing walls 25 generally orthogonal to the bed 12. An aperture 27 is provided in each of the walls 25 near the top 14. Handrails 26 are on each side of the slide 10, extending from the siderails 24 at the start section 22 upward and then downward in parallel with the ladder portion 18 and affixed thereto at a plurality of points.

A flow fitting 28 is rigidly mounted in each of the apertures 27 near the top 14 of the inclined bed 12. This location of the fittings 28 makes it possible to retro-fit existing slides with the slide wetting means disclosed herein. New slides 10 designed to include the presently disclosed wetting means need only provide apertures 27 in appropriate locations in the inward facing walls 25. The flow fittings 28 each include an escutcheon 30 and an elbow 34. The escutcheons 30 are fixed to the siderail 24 with a central axis 32 of each escutcheon 30 being approximately normal to the inward facing wall 25 and approximately parallel to the bed 12. The central axis 32 is generally indicative of a direction of water flow exiting the escutcheon 30. The elbow 34 connects the escutcheon 30 with a feed pipe 36. The feed pipe is approximately one inch in size. The elbow 34 and escutcheon 30 are of a similar size. The feed pipe 36, elbow 34 and escutcheon 30 could alternatively be of a larger size.

The escutcheons 30 are slightly offset from one another across the bed 12 with one being closer to the top 14 than the other. A main feed pipe 38 is connected to the feed pipes 36 on each side of the slide 10 through a T-fitting or the like (not shown). The main feed pipe 38 is connected to an outlet side of a water filter pump (not shown), in parallel with directional escutcheons (not shown) distributed around the pool which serve as flow outlets. The large pipe diameter (one inch or more) allows a relatively high rate of flow at relatively low pressure. This is well suited for use with the swimming pool filter pump having multiple flow outlets in parallel to one another. Such pumps displaces large volumes of water, but at relatively low pressure through the outlets. If one outlet is restricted or blocked, flow through that outlet decreases and flow through the other outlets increases without any significant change in pressure. Restrictive fittings (not shown) within or over the escutcheons 30, or overly small feed pipes 36, would therefore significantly reduce the volume of water flowing down the slide 10. The one inch fittings are recommended because that is approximately the size of fittings commonly used for filter outlets. It is to be appreciated that the term "flow fitting" is descriptive of not only the elbow and escutcheon combination as described here, but also equivalents thereof, such as but not limited to flow fittings molded integrally with the slide, or a combination of molded and later attached features.

A valve (not shown) may be installed somewhere along the length of the main feed pipe 38 to control flow to both the flow fittings 28 simultaneously. In addition to the ladder portion 18, the slide 10 also has vertical support members 40 supporting it.

A conventional pool slide is converted to a water slide in accordance with the present invention as follows. Apertures 27 are bored through the inward facing walls 25 near the top 14 of the slide bed 12. Flow fittings 28 are installed in the apertures 27. The flow fittings are connected to feed pipes 36 and then to a t-fitting (not shown) which is connected to the main feed pipe 38.

The water slide 10 is used in the following manner. The slide 10 is mounted adjacent to a pool with the bottom 16 of the slide 10 extending over an open area of the pool. The ladder portion 18 and vertical support members 40 are fixed to the ground to support the inclined bed 12. The main feed pipe 38 is connected to the water distribution system of the swimming pool filter (not shown), serving as one of a plurality of outlets for filtered water exiting the filter. The valve between the filter and the fittings 28 in the main feed pipe 38, if present, is opened to allow water flow through the main feed pipe to the flow fittings 28. Flow from the main feed pipe 38 is split at the t-fitting (not shown) and directed to two separate feed pipes 36, one connected to each of the fittings 28. Water passes through the elbows 36 and the escutcheon 30, exiting in a direction generally parallel with the axis 32 and transverses to a direction of slidings the water rapidly dropping to the inclined bed due to the force of gravity. The water impinges on the opposite rail 24 and is deflected back to the bed 12.

In some circumstances, water flow from a single escutcheon 30 will tend to remain relatively close to the rail 24 against which it impinges, leaving a significant portion of the slide bed 12 uncovered by water. It is appreciated that in a constant flow or high pressure system, a single restrictive fitting could be employed which could spray a large amount of fluid from a relatively small opening across the entire surface of the slide. However, such fittings are not effective at so wetting the slide when the pressure at the fitting is limited. Two substantially opposed escutcheons 30 are therefore employed to ensure water is distributed over substantially the entire slide bed 12 without the use of restrictive fittings.

The offset of the escutcheons 30 from one another prevents direct impingement of the exiting streams of water against one another. Such infringement would reduce fluid flow down the slide bed 12 by that amount of fluid which would otherwise go in the wrong direction and down the steps 20. This happens because the fluid inertia from the two opposed streams of water at the top 14 of the bed 12 would effectively cancel each other out, producing a large puddle at the top 14, with much of that puddle running down the steps 20. The offset A between the two axes 32 prevents the mutual cancellation of the inertia of the fluid streams exiting the escutcheon 30. The offset A also results in a more even distribution of water across the bed 12, as the water from two directly opposed streams would otherwise have a tendency to stay in the center of the bed 12 as it moved down the slide 10. The interaction of the two offset streams of the preferred embodiment produces a film of water over substantially all of the bed 12.

A person wishing to slide down first climbs up the steps 20, then seats themselves on the start section 22. The person then moves themselves to the top 14 of the bed 12 where the first of the fittings 28 is spreading water. The person then relaxes their grip on the rails 24, freely sliding into the pool with a film of water at substantially all times being disposed between them and the bed 12 of the slide 10 thereby eliminating friction therebetween, thus maximizing the comfort and enjoyment of the person sliding. The present invention in no way hinders or restricts the movement of the person down the slide 10, as the flow fittings 28 are completely removed from the path of one moving down the slide, as opposed to known slide wetting means where person may need to boost themselves over a tube or the like to get to the wet portion of the slide bed 12.

Obviously, many modifications and variations of the present invention are possible in light of the above teaching. It is therefore to be understood, that within the scope of the appended claims, the invention may be practiced otherwise than as specifically described.

I claim:

1. A water slide for use with swimming pools comprising:

an inclined bed extending from a top to a bottom;

a first side and a second side opposing each other across the bed and approximately extending from the top to the bottom;

a first flow fitting mounted in the first side with an opening located near a top of bed and positioned to direct water flow therefrom normal to the first side and substantially parallel to the inclined bed;

a second flow fitting mounted in the second side with an opening located near the top of the bed proximate to the top of the bed and positioned to direct a flow of water normal to the second side and substantially parallel to the bed; and a swimming pool filter including a high volume low pressure water pump having a plurality of outlets wherein at least one of the outlets is fluidly connected with the flow fittings mounted in the side rails, wherein the two flow fittings are offset by a predetermined amount sufficient to avoid inertia cancellation of opposed water streams exiting the fittings.

2. A water slide as claimed in claim 1, wherein the fittings and feed pipes supplying water thereto are of approximately a one inch size or larger.

* * * * *